US005632825A

United States Patent [19]

Coltrinari et al.

[11] Patent Number: 5,632,825

[45] Date of Patent: May 27, 1997

[54] APPARATUS AND METHOD FOR INHIBITING THE LEACHING OF LEAD IN WATER

[75] Inventors: Enzo L. Coltrinari, Golden; Jerome P. Downey, Parker; Wayne C. Hazen, Denver; Paul B. Queneau, Golden, all of Colo.

[73] Assignee: Technology Management Advisors LLC, Englewood, Colo.

[21] Appl. No.: 601,238

[22] Filed: Feb. 14, 1996

Related U.S. Application Data

[62] Division of Ser. No. 253,746, Jun. 3, 1994, Pat. No. 5,544,859.

[51] Int. Cl.[6] ..... C23C 22/52

[52] U.S. Cl. ..... 148/269; 427/394

[58] Field of Search ..... 427/394; 148/269

[56] References Cited

U.S. PATENT DOCUMENTS

| | | | |
|---|---|---|---|
| 2,802,733 | 8/1957 | Bungardt | 75/156.5 |
| 3,713,814 | 1/1973 | Larsson | 75/156.5 |
| 3,773,504 | 11/1973 | Niimi et al. | 75/157.5 |
| 4,180,398 | 12/1979 | Parikh | 75/157.5 |
| 4,551,395 | 11/1985 | Lloyd | 428/677 |
| 4,867,116 | 9/1989 | de Freitas Coutos Rosa et al. | 123/188 AA |
| 4,879,094 | 11/1989 | Rushton | 420/476 |
| 5,076,941 | 12/1991 | Boffardi et al. | 210/753 |
| 5,137,685 | 8/1992 | McDevitt et al. | 420/477 |
| 5,193,936 | 3/1993 | Pal et al. | 105/128 |
| 5,262,124 | 11/1993 | Yamaji et al. | 420/477 |

*Primary Examiner*—Sam Silverberg
*Attorney, Agent, or Firm*—Sheridan Ross P.C.

[57] ABSTRACT

A copper alloy plumbing fixture containing interdispersed lead particles coated noncontinuously on a water contact surface to resist the leaching of lead into potable water systems. The leach resistant fixture is prepared by immersing conventional copper alloys in a bismuth nitrate solution, selectively and noncontinuously coating the lead dispersoid particles on the water contact surface with bismuth. Tin may be substituted for bismuth to obtain similar results.

12 Claims, 6 Drawing Sheets

SHK

APPARATUS AND METHOD FOR INHIBITING THE LEACHING OF LEAD IN WATER

This is a divisional of application Ser. No. 08/253,746, filed Jun. 3, 1994, U.S. Pat. No. 5,544,859.

FIELD OF THE INVENTION

This invention generally relates to lead containing materials and products which are resistant to leaching lead into potable water systems used for human consumption and methods for the production thereof.

BACKGROUND OF THE INVENTION

Potable water systems are comprised of numerous components including pipe and plumbing fixtures such as faucets, valves, couplings, and pumps which both store and transport water. These components have traditionally been made of copper-based cast and wrought alloys with lead dispersed therein in amounts between 1–9% by weight. The lead allows these components to be more easily machined into a final product which has both a predetermined shape yet acceptable strength and watertight properties.

The lead used to improve the machinability of these copper alloy materials has been proven to be harmful to humans when consumed as a result of the lead leaching into potable water. This damage is particularly pronounced in children with developing neural systems. To reduce the risk of exposure to lead, federal and state governments now regulate the lead content in potable water by requiring reductions in the amount of lead which can leach from plumbing fixtures. A variety of strategies have been developed to address this problem. For example, simply reducing the amount of lead in plumbing fixtures has been attempted. However, such low lead content alloys are difficult to machine.

Another strategy is to develop specific alloys such as that disclosed in U.S. Pat. No. 4,879,094 to Rushton. The patent describes an alloy which contains 1.5–7% bismuth, 5–15% zinc, about 1–12% tin and the balance copper. This copper alloy is capable of being machined, but must be cast and not wrought. This is undesirable since a wrought alloy may be extruded or otherwise mechanically formed into shape. It is thus not necessary to cast objects to a near finished shape. Further, wrought alloy feed stock is more amenable to high speed manufacturing techniques and generally has lower associated fabrication costs than cast alloys.

A copper based machinable alloy with a reduced lead content or which may be lead free was disclosed by McDivitt in U.S. Pat. No. 5,137,685. This alloy contains from about 30–58% by weight zinc, 0–5% weight of bismuth, and the balance of the alloy being copper. This alloy is expensive to produce, however, based both on the cost of the bismuth as compared to lead, and further since the bismuth must be thoroughly mixed within the matrix of the copper alloy material.

Despite the developments made in the area of reduced lead leaching into potable water systems, there remains a need to provide a material which is less susceptible to leaching lead into potable water systems, yet which utilizes the inherent benefits of copper alloys that contain lead.

SUMMARY OF THE INVENTION

This discovery is accomplished by an apparatus for conducting the flow of a fluid. The apparatus comprises a solid body piece having a conduit surface that defines a conduit volume through which the flow of a fluid may be directed. The body piece comprises a first solid phase, which is a continuous phase, and a second solid phase of dispersoids comprised of lead dispersed in the first solid phase. A plurality of the dispersoids are present adjacent the conduit surface of the solid body piece.

The apparatus further includes a surface coating at the conduit surface which comprises multiple distinct occurrences of coating material. At least a portion the occurrences being interposed between at least a portion of the conduit volume and at least a portion of the plurality of dispersoids.

The invention further includes an article useful in fluid storage and transportation with a composition comprising an interior portion having a metal matrix comprising greater than about fifty weight percent copper. The interior portion does not have any exposed surface. The article additionally has a perimeter portion integral with the interior portion and an exposed surface that may be in contact with a fluid. The perimeter portion has dispersoids comprising lead dispersed throughout a metal matrix which comprises greater than about fifty weight percent copper.

The article further includes a coating in the perimeter portion comprised of a metal coating material. The coating has a top side and a bottom side, the top side forming a part of the exposed surface and the bottom side being adjacent to at least one dispersoid in said perimeter portion. The coating substantially physically separates the lead in at least one dispersoid from the exposed surface.

The invention further includes a solid material useful in water service. The material comprises an interior matrix phase which comprises copper, an exterior surface, and a dispersed phase of particles consisting essentially of lead. The lead is dispersed in the interior matrix with a plurality of the lead particles adjacent the exterior surface. The material additionally has a noncontinuous coating material at the exterior surface which substantially physically separates the lead in at least a portion of the plurality of lead particles from the exposed surface.

The invention further includes an article for use in fluid containment and transportation. The article comprises a flow directing piece shaped to provide a fluid flow conduit, the flow directing piece having an exterior surface. The interior surface includes a fluid contact surface adjacent the fluid flow conduit. The apparatus further includes a perimeter portion in the flow directing piece which comprises the exterior surface. The perimeter portion extends to a depth smaller than about 100 microns into the body portion from the surface of the exterior portion. The perimeter portion may comprise lead. The apparatus flow directing piece further includes an interior portion which is surrounded by the exterior portion, the interior portion comprising lead. The flow directing piece further includes a lead leach inhibitor, the perimeter portion having an average concentration of lead leach inhibitor that is greater than the average concentration of lead leach inhibitor in the interior portion.

The invention further includes a copper-based metal composition. The composition comprises greater than about 50 weight percent copper, from about one weight percent to about ten weight percent lead, and less than about 0.005 weight percent of a lead leach inhibitor metal selected from the group consisting of bismuth or tin, and combinations thereof.

The invention further includes a method for preparing the surface of a copper-containing article. The article comprises a solid continuous phase comprising copper and a solid noncontinuous phase of dispersoids comprising lead dispersed in the continuous phase. The article has an exposed surface, wherein the continuous phase and a plurality of the dispersoids forms at least a part of the exposed surface. The method includes covering at least a portion of the lead in the plurality of dispersoids with a noncontinuous coating phase.

As the aforementioned embodiments of the invention disclose, lead containing copper-based alloys may be effectively treated to prevent lead from leaching into water systems. This treatment may be done efficiently and in a cost effective manner utilizing conventional alloys. Other objects and advantages of the invention will become apparent upon reading the following detailed description and appended claims, and upon reference to the accompanying drawings.

Figure 1:
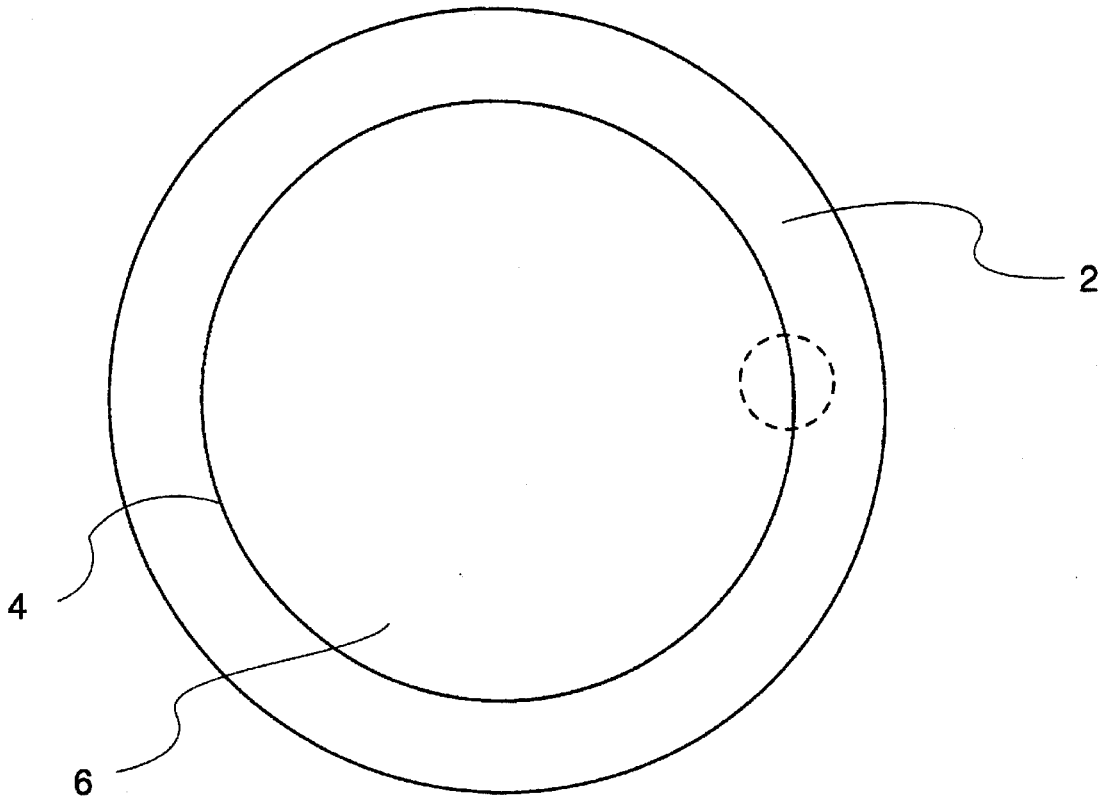
FIG. 1 depicts a cross-sectional view of a pipe or plumbing fixture capable of storing or transporting potable water or other fluids.
Figure 2:
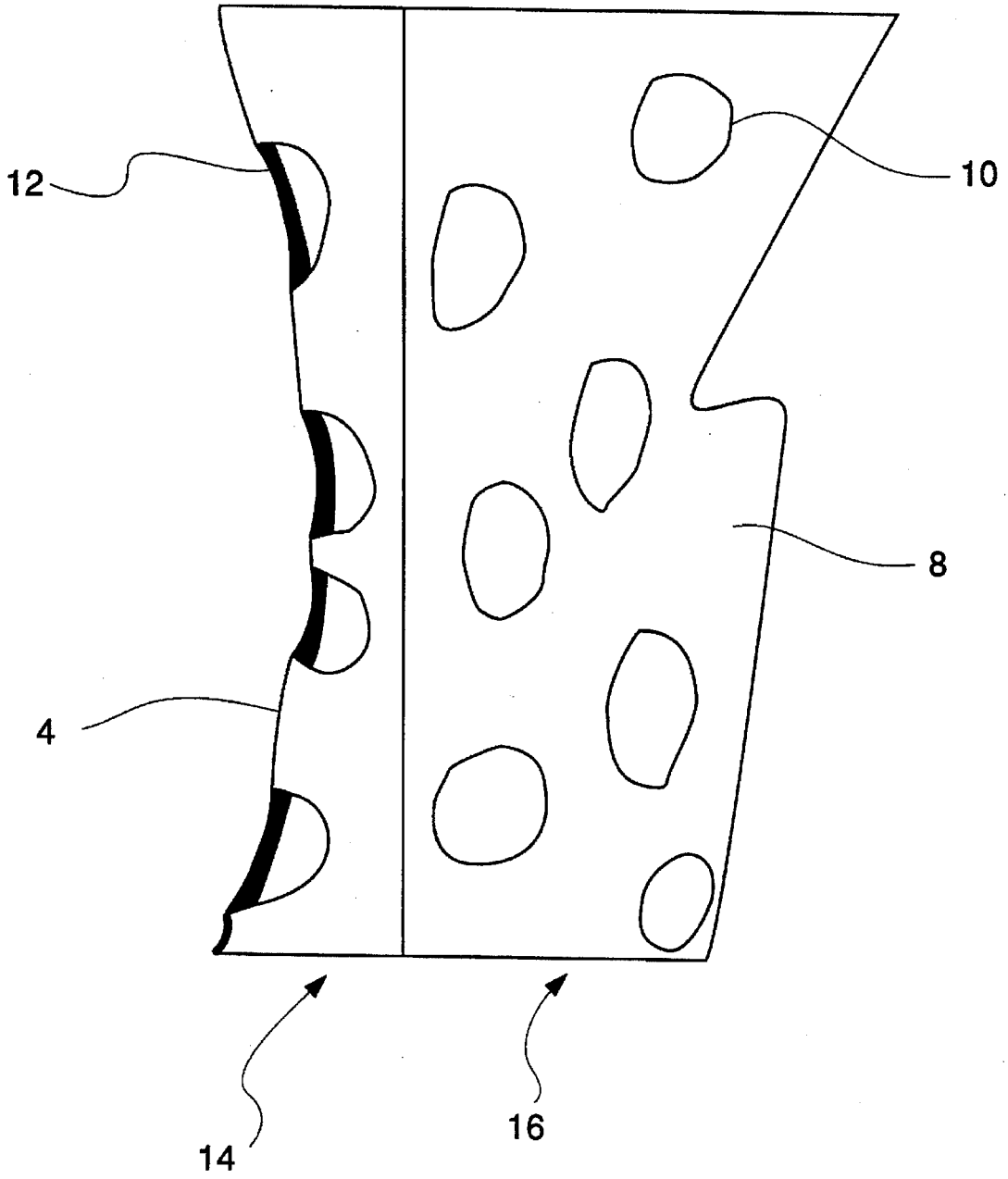
FIG. 2 is an expanded cross-sectional view depicting the conduit surface, perimeter portion, first solid phase, second solid phase, and non-continuous surface coating.

It should be understood that the drawings are not to scale, and that the invention is not necessarily limited to the particular embodiments illustrated herein.

DETAILED DESCRIPTION OF THE PREFERRED EMBODIMENT

The present invention is used for conducting the flow of fluids such as water, while inhibiting the leaching of lead into the fluid. The invention may include pipes, valves, faucets, pumps and other commonly known plumbing fixtures. The materials typically used in the production of these plumbing fixtures include copper alloys, such as brass, which have lead dispersed throughout the alloy material. The materials are characterized in that lead which is exposed to the water transportation surface of the apparatus is selectively coated with a non-continuous surface coating which substantially precludes lead from leaching into the water.

One embodiment of the present invention is an apparatus for conducting the flow of fluid. The apparatus includes a solid body piece 2 having a noncontinuous surface coating 12. The flow directing or solid body piece 2 is shaped such that it has a conduit surface 4 which defines a conduit volume 6. The conduit volume 6 is the space through which the apparatus is designed to have fluid flow. For example, in the instance where the apparatus is a pipe, the conduit surface 4 is the inside surface of the pipe, which contacts water flowing through the pipe on the fluid contact or conduit surface 4.

The solid body piece 2 includes a first continuous solid phase 8 and a second solid phase 10 of dispersoids within the first continuous solid phase 8. For instance, in the case of a brass pipe having lead dispersoids throughout the brass, the brass is the first continuous solid phase 8 and the lead constitutes the second solid phase of dispersoids 10.

The first continuous solid phase 8 is typically metal and more typically comprises copper. For example, the first continuous solid phase 8 can be a copper alloy and can contain over 50% by weight of copper. Such copper alloys can be brass including Cu/Zn/Si; Mn bronze; leaded Mn bronze and a variety of bronzes including Cu/Sn; Cu/Sn/Pb; Cu/Sn/Ni; Cu/Al; and other high copper alloys containing 94–98.5 weight percent Cu and 0.02 weight percent lead. The alloys typically include between about 50 weight percent and about 98.5 weight percent Cu, more preferably between about 53.5 weight percent and about 94 weight percent Cu and more preferably between about 60 weight percent and about 82 weight percent Cu. In a preferred embodiment of the present invention, a continuous solid body phase comprised of about 57%–82% copper, 0.2% tin, 7%–41% zinc, 2%–8% lead, and trace amounts of iron, antimony, nickel, sulfur, phosphorous, aluminum and silicon is used.

The second solid phase of dispersoids 10 comprise lead. The lead dispersoids are dispersed in the first continuous solid phase 8 and a plurality are adjacent the fluid contact or conduit surface 4. Thus, while the lead dispersoids are contained throughout the interior matrix of the first continuous solid phase 8, some portion can be exposed on the fluid contact or conduit surface 4. Therefore, untreated solid body pieces 2 having lead exposed to fluids flowing throughout the conduit volume 6 allow for the leaching of lead into the fluid, which may contaminate the fluid. Typically, lead dispersoids approximately comprise 1–9% by weight of the solid body piece 2 and more typically 3–5%. In one embodiment, the second solid phase of dispersoids 10 consists essentially of lead. The plurality of lead dispersoids allows the solid body piece 2 to be machined more easily and allows for the use of wrought alloy feed stock rather than cast alloy components. In addition to lead dispersoids, the second solid phase of dispersoids 10 can include dispersoids comprised of elements which can be the same as the non-continuous surface coating 12, i.e., gold, palladium, silver, platinum, tin and bismuth.

In accordance with the present invention, the apparatus also includes a non-continuous surface coating 12 at the conduit surface 4 which includes multiple distinct occurrences of a coating material. The occurrences are interposed between at least a portion of the conduit volume 6 and at least a portion of the lead dispersoids. In this manner, lead dispersoids are impeded from leaching lead into fluids, such as potable water, which flow through the conduit volume 6. One characteristic of the coating material is that it is effective as a coating of the dispersoids under normal use conditions for normal product lifetimes. Such coating characteristics are typified by the coatings and coating processes discussed below.

The coating of the second solid phase of lead dispersoids 10 inhibits the leaching of lead into fluid which passes through the conduit volume 6 and which otherwise would be in contact with the second solid phase of lead dispersoids 10. In a preferred embodiment of the present invention, at least about 90% of the surface area of the second solid phase of lead dispersoids 10 exposed on the conduit surface 4 are covered by the non-continuous surface coating 12. In a more preferred embodiment, at least about 95% of the second solid phase of lead dispersoids 10 exposed on the conduit surface 4 are covered by the noncontinuous surface coating 12 and in a most preferred embodiment 99%.

In accordance with the present invention, the noncontinuous surface coating 12 can comprise any metal which is more electropositive than lead. For example, the surface coating can comprise a material selected from the group consisting of bismuth, tin, gold, palladium, platinum and silver. Preferably, the noncontinuous surface coating 12 comprises material selected from the group consisting of bismuth and tin, or combinations thereof, and most preferably, the coating comprises bismuth.

The non-continuous surface coating 12 typically has a thickness no less than about 1.2 nanometers, with a preferred thickness no less than about 4 nanometers. It should be recognized, however, that any minimum thickness of non-continuous surface coating which provides adequate lead coverage over the reasonable lifetime of the fixture at an economical cost is acceptable. In a preferred embodiment of the present invention the non-continuous surface coating 12 is comprised of bismuth with a thickness no less than about 4 nanometers.

In another embodiment of the apparatus of the present invention, the solid body piece 2 of the apparatus comprises a perimeter portion 14 which includes the conduit surface 4 and an interior portion 16 which is integral with the perimeter portion 14. The interior portion 16 does not include the conduit surface 4. In this embodiment, the interior portion 16 of the solid body piece 2 typically has a lower concentration of coating material than the perimeter portion 14. Thus, the coating material is not uniformly distributed throughout the solid body piece 2, because typically the coating material is applied directly to the conduit surface 4. In another embodiment, the interior portion 16 of the body piece is substantially free of coating material.

The perimeter portion 14 of the apparatus includes the conduit surface 4 and extends from the conduit surface 4 into the solid body piece 2 a distance less than about 100 microns below the conduit surface 4, and more preferably extends into the body piece a distance less than about 50 microns. Thus, it should be understood that the coating material is not only on the conduit surface 4, but can also extend into the perimeter portion 14 of the apparatus some measurable distance depending on the method of application of the coating material to the apparatus.

The present invention also includes as another embodiment an article useful for fluid storage and transportation. This article may be used as a pipe, faucet, valve, pump or other plumbing fixture or device for fluid storage and transportation. The article includes an interior portion 16 having no surface exposed to the water or other fluid being stored or transported throughout the article. The interior portion 16 has a metal matrix typically comprising greater than about 50 weight percent Cu, more preferably greater than about 53.5 weight percent Cu, and even more preferably greater than about 60 percent Cu. Other metals comprising lead, tin, iron, silver, palladium, platinum, zinc and bismuth may make up the remainder of the metal matrix of the interior portion 16, depending on the alloy. The interior portion 16 composition will usually comprise between about 1 and about 10 weight percent lead. Lead is typically present as a dispersed solid phase in the matrix of the interior portion 16.

The interior portion 16 is integral to and adjacent to a perimeter portion 14, which has an exposed surface that may be in contact with a fluid being transported or held within the article. For example, the exposed surface of the perimeter portion 14 would be actually wetted by the fluid. The perimeter portion 14 includes dispersoids of lead in a metal matrix which typically comprises greater than about 50 weight percent of copper. Other metals such as lead, zinc, tin and iron may additionally be included in the metal matrix in the form of a copper alloy.

The article of the present invention further includes a coating or lead leach inhibitor comprising a metal coating material in the perimeter portion 14, the coating having both a top side and bottom side. The top side of the coating forms part of the exposed conduit surface 4 while the bottom side is adjacent and overlaps at least one lead dispersoid in the perimeter portion 14. The coating thus substantially physically separates any such lead dispersoids from the exposure to water. This separation effectively prevents lead from leaching into water stored or carried in the article, since the lead dispersoids are not in substantial contact with water at the exposed surface. In a preferred embodiment, the coating material substantially physically separates the coated lead dispersoids for the reasonable expected lifetime of the apparatus.

In a further aspect of the invention, the coating of the lead dispersoids can be noncontinuous across the exposed conduit surface 4. Thus, the coating is substantially consistent with the random number and pattern of lead dispersoids which are at the exposed surface. These separate occurrences of coating material are adjacent to a corresponding lead dispersoid in the perimeter portion 14 of the article, and substantially physically separate the corresponding adjacent lead dispersoid from the exposed conduit surface 4. As referenced above, the noncontinuous coating preferably covers a substantial portion of the lead dispersoids.

Another embodiment of the present invention is a copper-based material. In a preferred embodiment, the composition comprises greater than about 50 weight percent copper, from about 1 weight percent to about 10 weight percent lead, and up to about 0.005 weight percent of a lead leach inhibitor metal. The lead leach inhibitor metal is typically a metal which is more electropositive than lead and preferably is selected from the group consisting of bismuth, tin, gold, palladium, platinum, silver and combinations thereof. More preferably the lead leach inhibitor metal is bismuth.

In a preferred embodiment of the composition, the copper-based metal composition comprises from about 7 weight percent to about 41 weight percent zinc. In a further embodiment, the copper-based metal composition comprises from about 0.2 to about 0.6 weight percent tin.

Another embodiment of the present invention is a method for preparing the surface of a copper containing material to impede the leaching of lead into water or other fluids. The article may be, for instance a plumbing apparatus which defines a fluid conduit volume 6 for storing or directing the flow of fluids through the apparatus. The plumbing apparatus may include, but is not limited to, pipes, valves, faucets, fittings, and other fixtures commonly known in the art. The composition and structural aspects of the article, which typically includes copper, are the same as that of the apparatus and articles, as broadly described above, but without the coating material or lead leach inhibitor.

The process includes providing the article and covering at least a portion of the lead in the plurality of dispersoids with a noncontinuous surface coating phase 12. Thus, the method can include preferentially covering the dispersoids and leaving the continuous phase at the exposed conduit surface 4 of the article substantially uncovered by the coating phase. This method of selectively covering substantially reduces the amount and cost of coating material required to effectively coat the lead dispersoids exposed on the exposed surface as compared to a continuous coating process. For example, in a continuous coating process, the entire surface exposed to fluid is coated, including both the lead dispersoids and non-lead alloys. This continuous coating may be more expensive since a large non-lead surface area is coated unnecessarily. In a preferred embodiment of the invention, typically at least about 90% of the lead dispersoids present at the exposed surface are covered, more preferably about 95% and most preferably 99%. Further, the continuous phase of the exposed surface should remain substantially uncovered with no more than about 20% covered by the coating phase, more preferably less than about 10% covered by the coating phase, and most preferably less than about 1% covered by the coating phase.

The step of covering the dispersoids can comprise removing a layer of a portion of the plurality of dispersoids from the exposed conduit surface 4 to a depth extending into the material and below the exposed surface. For example, the step of removing can be a chemical substitution reaction to substitute a layer of the coating material, such as bismuth, for the layer of lead from an exposed dispersoid.

The layer of lead dispersoids removed typically extends a depth of about 10 microns from the exposed conduit surface 4 into the solid continuous phase, and more preferably about 5 microns. As the layer of a portion of the plurality of dispersoids is removed, at least a portion of the removed layer is replaced with the coating material. The noncontinuous coating phase is typically comprised of bismuth, tin, gold, palladium, platinum, silver, or combinations thereof. Preferably, the coating material is comprised of bismuth.

In a preferred embodiment of the present method, the step of covering typically comprises contacting the clean, exposed conduit surface 4 of the material with a solution having dissolved therein a metal selected from the group consisting of bismuth, tin, gold, palladium, platinum or silver and combinations thereof. The concentration of the metal in solution will depend upon the choice of salts and is typically between about 0.25 g/l to 2.0 g/l, and more preferably between about 1.0 g/l and 1.5 g/l. The metal is typically provided in the solution in the form of a nitrate, sulfate or other soluble salt.

The article can be treated to cover the article with a coating phase by immersion in the solution for a sufficient time to adequately coat the article. It will be noted that the process is most efficiently conducted by minimizing the amount of time the article is contacting with the solution.

The temperature of the treating solution is typically about 60° C., although the temperature of the solution can range from about 15° C. to just below the boiling point of the solution. Wide variations in the temperature of the treating solution during treatment are unfavorable, however.

By use of the apparatus, articles or methods of the present invention, the leaching of lead from plumbing fixtures into potable water systems is significantly reduced. The effectiveness of the present invention can be quantitatively measured in various ways. For example, as noted above, the percent coverage by a coating material or lead leach inhibitor of lead dispersoids exposed on the surface of a fluid conduit can be measured, for example by electron microscopic techniques. In addition, the effectiveness of the present invention in reduction of lead leaching into water can be quantitatively measured by tests which measure the amount of lead in water which has been allowed to stand in contact with a fixture under standardized conditions. For example, one standardized procedure has been established by the National Sanitation Foundation and is known as the National Sanitation Foundation 61 ("NSF-61") procedures. More specifically, Section 9 of the NSF-61 publication discusses the procedure for testing mechanical plumbing devices and components.

The NSF-61 standardized procedure requires the triplicate testing of mechanical plumbing fixtures, wherein samples are rinsed with tap water at room temperatures, then filled with water at various temperatures for periods of time up to 90 days. The contaminant level of lead which has leached into the water from the fixture is then quantitatively measured to gauge the leach resistance characteristics of the particular plumbing apparatus or fixture. This procedure is discussed in detail below in the Example section.

As an example of the effectiveness of the disclosed invention, untreated wrought brass alloys normally obtain a NSF-61 score of about 10 micrograms/liter when the alloy is exposed to water for a period of 1 day. Thereafter, the concentrations of lead fell within the range of 3–6 micrograms/liter during subsequent days of testing. However, after treating these alloys by exposing the second solid phase of lead dispersoids 10 with a lead leach inhibitor as described herein for 30 minutes, a NSF-61 score typically between about 1–2.5 micrograms/liter was obtained after exposing the fixture to water for a 1 day period. The lead concentrations fell to less than 1 microgram/liter during each of the subsequent days of testing. Typically, after treatment of copper-containing fixtures by the present invention, lead leaching under standardized conditions can be reduced by about 80 percent, more preferably by about 90 percent and more preferably by about 95 percent.

Similarly, typical NSF-61 scores for untreated cast brass ranges from about 50–55 micrograms/liter after exposure to water for 1 day, declining to about 38 micrograms/liter on day 2, and ranging from about 13–25 micrograms/liter for subsequent days of testing. After treatment of these cast brass alloys in a lead leach inhibitor for 30 minutes, a NSF-61 score of less than about 6 micrograms/liter is obtained after exposure to water for 1 day, and less than 2 micrograms/liter in each of the subsequent days. Typically, by treating cast copper-containing brass fixtures by the present invention, lead leaching under standardized conditions can be reduced by about 80 percent, more preferably by about 90 percent and more preferably by about 95 percent.

The following experimental results are provided for purposes of illustration and are not intended to limit the scope of the invention.

EXAMPLES

Example 1

This example illustrates the treatment of various plumbing fixtures according to the present invention. These treatments were conducted using four types of wrought and cast brass components commonly used in plumbing fixtures.

The first brass component was a single handle kitchen ("SHK") specimen containing both wrought and cast components. The second and third components were comprised of wrought brass and included a single handle lavatory ("SHL") and double handle lavatory specimen ("DHL"). The fourth component was a wide spout ("WSP") comprised of cast brass.

The nominal composition of the wrought brass in the tested specimens was comprised of 60.0–63.0 weight percent copper, 2.5–3.7 weight percent lead and the remainder zinc. The nominal composition of the cast brass in the tested specimens was comprised of 78.0–82.0 weight percent copper, 2.3–3.5 weight percent tin, 6.0–8.0 weight percent lead, 7.0–10.0 weight percent zinc, 0.4 weight percent iron, 0.25 weight percent antimony, 1.0 weight percent nickel, 0.08 weight percent sulfur, 0.02 weight percent phosphorous, 0.005 weight percent aluminum and 0.005 weight percent silicon.

Each type of fixture included three samples which were treated according to the embodiments of the present invention and subsequently tested according to NSF-61 standards as described in Example 2.

The fixtures were prepared for treatment by rinsing each component with acetone, followed by immersion in 0.1 normal (N) nitric acid ($HNO_3$) for 30 seconds. The fixtures were subsequently rinsed with deionized water and allowed to air dry prior to testing.

Each set of three fixtures was then immersed for a 30 minute period in a solution prepared by adding 4.64 g/l of bismuth nitrate ($Bi(NO_3)_3.5H_2O$) and 15 g/l of sodium chloride (NaCl). The solution was prepared by dissolving the salt in an agitated volume of deionized water, maintained at 60° C.

The process tank consisted of a seven gallon polyvinyl pail fitted with an agitator and baffles. The bismuth nitrate and sodium chloride solution was circulated by allowing the process tank to overflow into a reservoir, then pumping fluid from the reservoir back into the process tank. The treatment sequence of the fixtures was as follows: SHL, DHL, WSP and SHK. After the treatment of the HL fixture, two hundred and fifty milliliters (ml) of the bismuth nitrate solution were added to the system to insure against bismuth depletion prior to the treatment of the HHL fixture. Likewise, an additional two hundred and fifty milliliters were added before the treatment of the WSP and KSP fixture treatments, as was 181 ml before the HK fixture treatment to ensure against bismuth depletion. Treatment solution samples were drawn from the virgin treatment solution and after the treatment of each fixture to determine the amount of lead which leached from the fixture into the treatment solution. The results of these tests are tabulated below in Table 1.

TABLE 1

Residual Accumulation of Lead in Solution

| SOLUTION DESCRIPTION | Pb Content, g/l |
|---|---|
| Virgin Solution | <0.001 |
| Solution From SHL Fixture | 0.001 |
| Solution From DHL Fixture | 0.005 |
| Solution from WSP Fixture | 0.008 |
| Solution from SHK Fixture | 0.047 |

After removing the test fixtures from the bismuth nitrate solution, the specimens were thoroughly rinsed with deionized water and allowed to air dry before being subjected to leachate testing. The lead leachate testing was performed using the standardized NSF-61 leaching tests as discussed below.

Example 2

This example illustrates The NSF-61 testing procedure performed on the fixtures following treatment. This procedure requires that the fixtures are flushed with tap water for 15 minutes, then rinsed with deionized water. The fixtures are then prepared for testing by rinsing with 3 volumes of an extraction water having a pH of 8.0±0.5, alkalinity of 500 ppm, dissolved inorganic carbonate of 122 ppm and 2 ppm of free chlorine in reagent water.

Following the aforementioned fixture preparation, the fixtures are exposed to extraction water at either a cold temperature or hot temperature, depending on the intended use of the fixture. The cold temperature is 23°±2° C. (73.4°±3.6° F.), while the hot temperature is 60°±2° C. (140°±3.6° F.) for domestic use or 82°±2° C. (180°±3.6° F.) for commercial use. For the purposes of this test, each fixture treated was tested with cold extraction water.

On day 1, the fixtures are filled with the extraction water for approximately 2 hours, then the water is dumped and the process repeated for a total of 4 exposures. After dumping the fourth water sample, the fixture is again filled with extraction water and held in the fixture for approximately 16 hours.

On day 2, the water samples are collected and acidified and then tested for lead content in accordance with NSF-61 procedures. Day 1 procedures are then repeated. For the duration of the test, day 1 and day 2 procedures are repeated. The tests may be extended with an exposure sequence of up to 90 days, although only the contaminant levels present in the overnight samples are used to evaluate lead-leaching.

Figure 3:
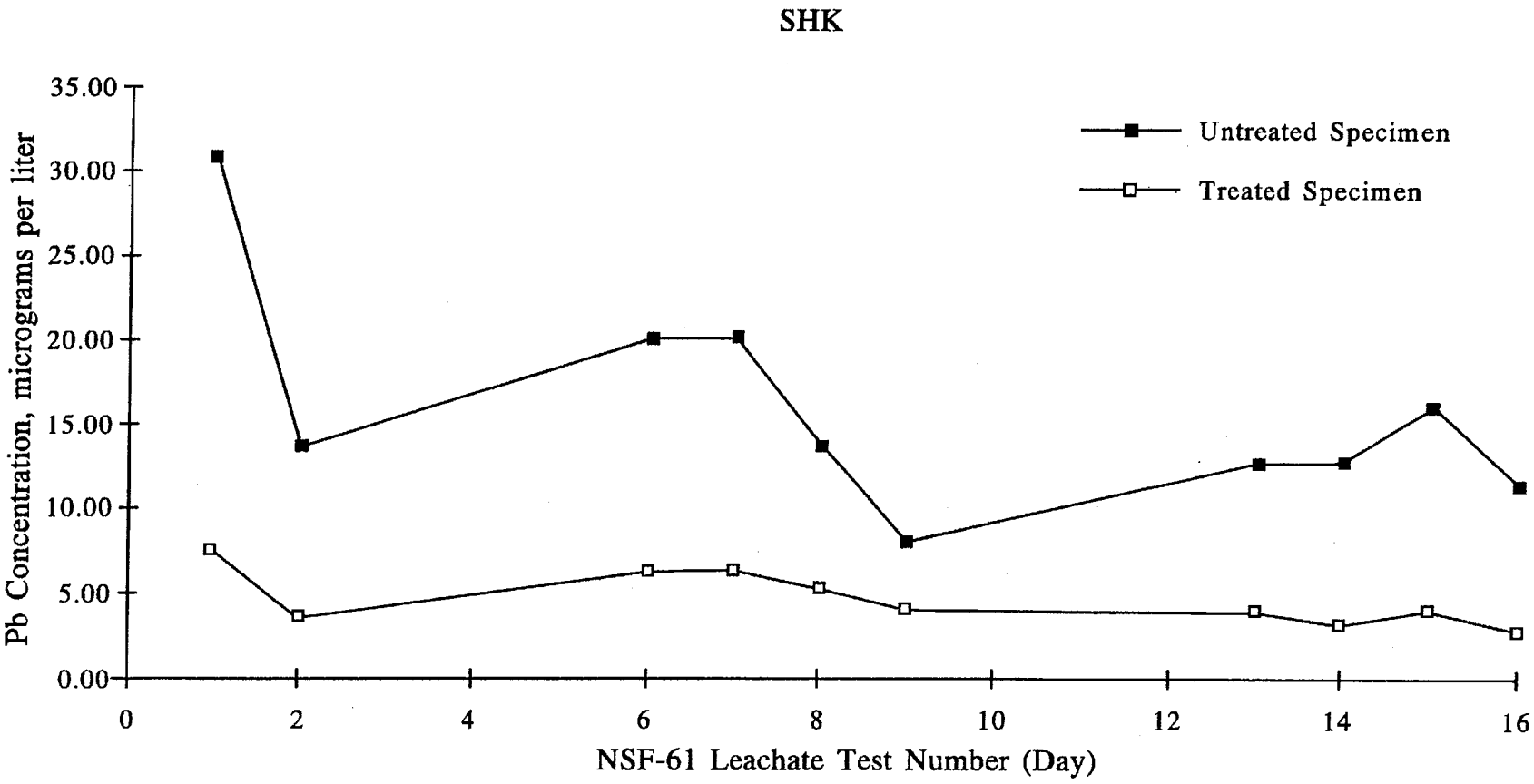
FIGS. 3–6 illustrate quantitative test data obtained from experiments performed on treated and nontreated copper alloy test fixtures.
Figure 4:
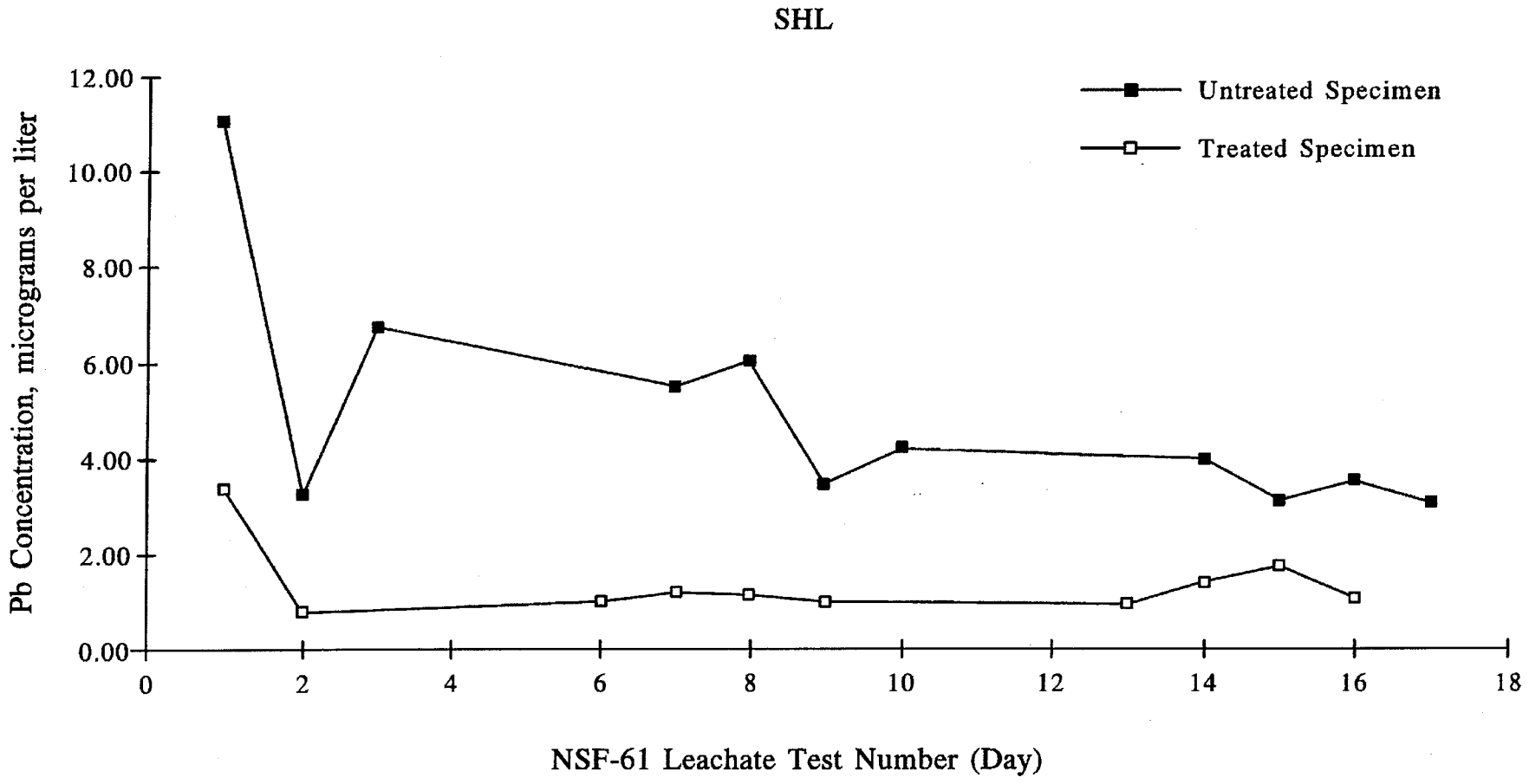
Figure 5:
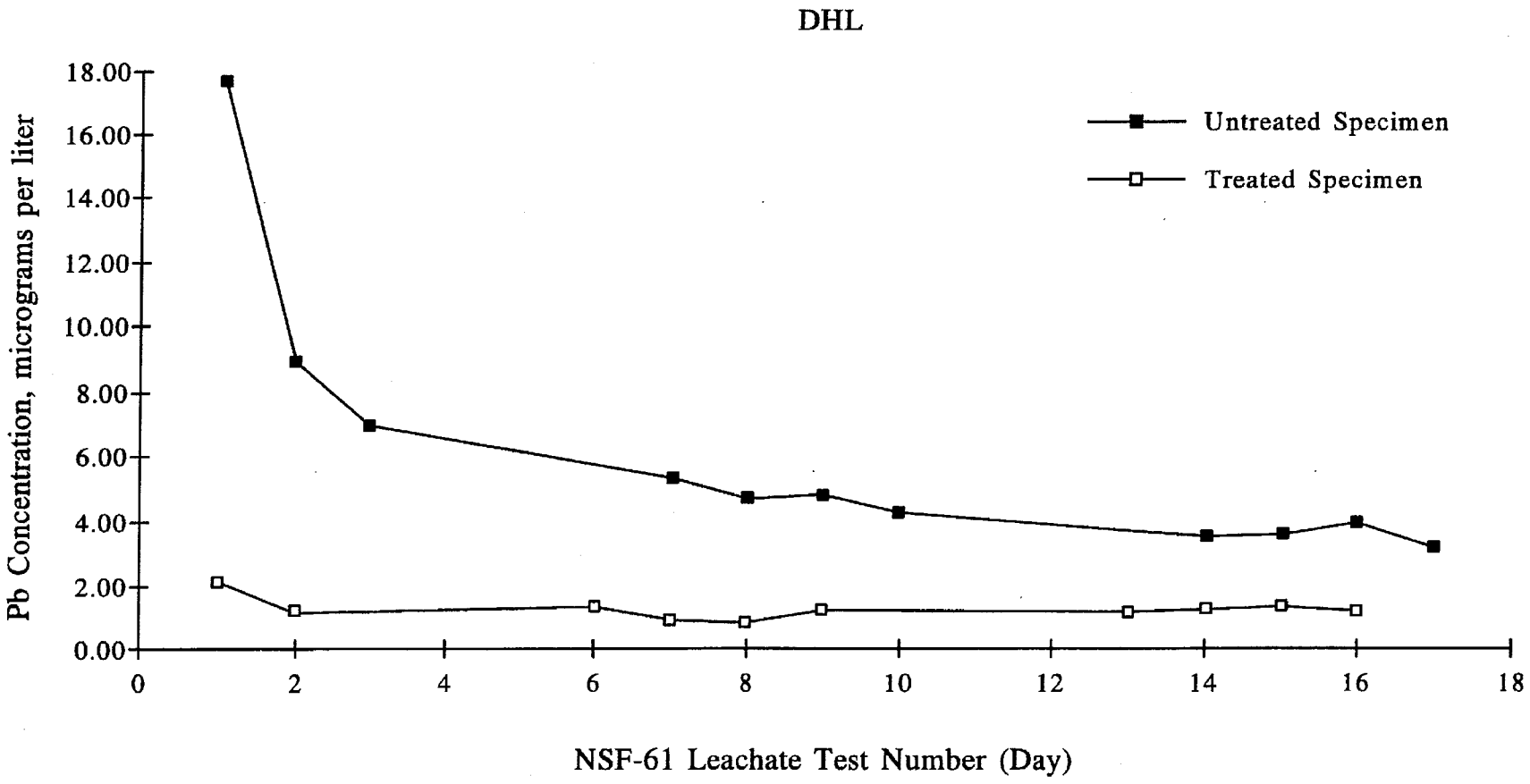
Figure 6:
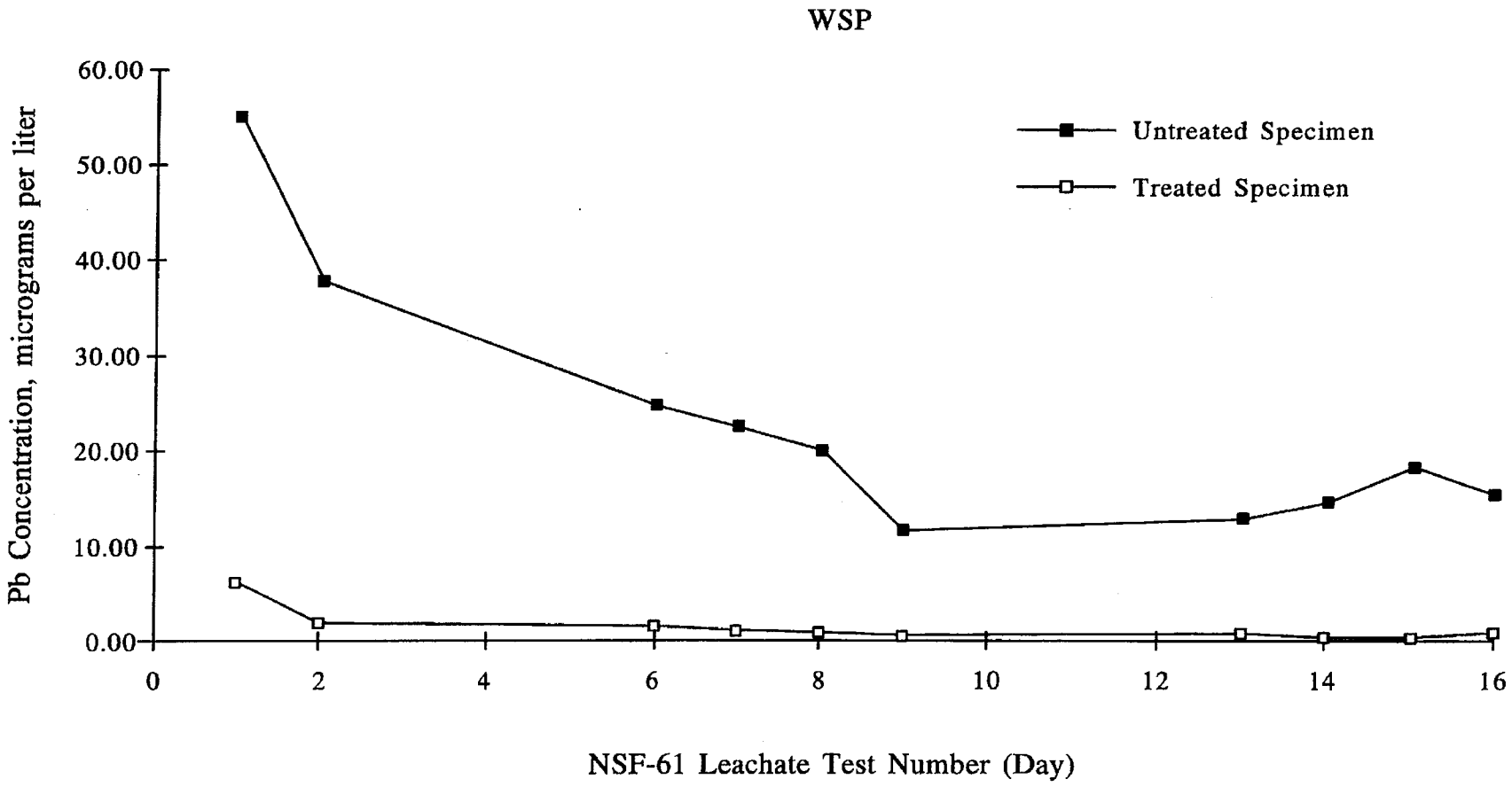

The results of the NSF-61 leaching tests can be seen in FIGS. 3–6, which depict the concentrations of lead leached into the water in micrograms/liter on the Y axis plotted against the days of water exposure on the X axis. Although a total of five fixtures were treated and subsequently tested in accordance with NSF-61 procedures, only four figures were generated since the SHK and KSP fixtures were assembled prior to NSF-61 leaching tests. As the Figures depict, the copper alloy specimens treated by the bismuth nitrate solution are compared with non-treated samples.

As the test data indicates, the amount of lead leaching into water from copper-alloy fixtures is significantly reduced following the bismuth treatment. Typically, the amount of lead leaching into water is reduced about 90 percent, and more preferably reduced about 95 percent.

While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A method for preparing a surface of a copper-containing article, said method comprising the steps of:

providing an article comprising a solid continuous phase comprising copper and a solid noncontinuous phase of dispersoids comprising lead dispersed in said continuous phase, said article having an exposed surface, said continuous phase and a plurality of said dispersoids forming at least a part of said exposed surface; and reacting at least a portion of said lead in said plurality of dispersoids with a noncontinuous coating phase.

2. The method of claim 1, wherein said step of covering comprises preferentially covering a portion of said plurality of dispersoids and leaving said continuous phase at said exposed surface substantially uncovered by said coating phase.

3. The method of claim 1, wherein said step of covering comprises removing a layer of a portion of said plurality of dispersoids from said exposed surface to some depth into said article below said exposed surface and replacing at least a part of said removed layer with said coating phase.

4. The method of claim 1, wherein said continuous phase comprises greater than about 50 weight percent copper.

5. The method of claim 1, wherein said dispersoids consist essentially of lead.

6. The method of claim 1, wherein said noncontinuous coating phase comprises bismuth.

7. The method of claim 1, wherein said noncontinuous coating phase comprises tin.

8. The method of claim 1, wherein said step of covering comprises contacting said exposed surface with a liquid solution having dissolved therein a metal selected from the group consisting of bismuth, tin and combinations thereof.

9. A method for treating a plumbing apparatus, said method comprising the steps of:

first providing an apparatus, said apparatus shaped so as to structurally define a fluid conduit volume for directing the flow of fluids through said apparatus, said apparatus comprising a continuous matrix phase having greater than about 50 weight percent copper and a dispersed phase comprising lead;

said article having a fluid contact surface adjacent said fluid conduit volume;

contacting said fluid contact surface with a treating material comprising metal selected from the group consisting of bismuth, tin and combinations thereof; and second providing a coating comprising coating material across at least a portion of said fluid contact surface, said coating material selected from the group consisting of bismuth, tin and combinations thereof.

10. The method of claim 9, wherein said matrix phase comprises from about 50 weight percent to about 98.5 weight percent copper and from about 1 weight percent to about 42 weight percent zinc.

11. The method of claim 9, wherein said matrix phase comprises from about 50 weight percent to about 98.5 weight percent copper and from about 0 weight percent to about 20 weight percent tin.

12. The method of claim 9, wherein said coating is noncontinuous across said fluid contact surface.

* * * * *